US005823427A

United States Patent [19]

Dupre et al.

[11] Patent Number: 5,823,427

[45] Date of Patent: Oct. 20, 1998

[54] METHOD AND APPARATUS FOR MAKING SNOW

[75] Inventors: Herman K. Dupre, Champion, Pa.; Charles N. Santry, Chesnut Hill, Mass.

[73] Assignee: Snow Economics, Inc., Natick, Mass.

[21] Appl. No.: 875,627

[22] PCT Filed: Nov. 12, 1996

[86] PCT No.: PCT/US96/18051

§ 371 Date: Jul. 24, 1997

§ 102(e) Date: Jul. 24, 1997

[87] PCT Pub. No.: WO91/18421

PCT Pub. Date: May 22, 1997

[51] Int. Cl.[6] ..... F25C 3/04

[52] U.S. Cl. ..... 239/14.2; 239/423

[58] Field of Search ..... 239/2.2, 14.2, 239/423

[56] References Cited

U.S. PATENT DOCUMENTS

| | | | |
|---|---|---|---|
| 3,408,005 | 10/1968 | Struble et al. | 239/14.2 |
| 3,761,020 | 9/1973 | Tropeano et al. | 239/2.2 |
| 3,762,176 | 10/1973 | Coggins, Jr. | 62/74 |
| 3,822,825 | 7/1974 | Dupre | 239/14.2 |
| 3,829,013 | 8/1974 | Ratnik | 239/14.2 |
| 3,908,903 | 9/1975 | Burns, Jr. | 239/2.2 |
| 3,923,247 | 12/1975 | White | 239/14.2 |
| 3,952,949 | 4/1976 | Dupre | 239/2.2 |
| 3,964,682 | 6/1976 | Tropeano et al. | 239/2.2 |
| 4,101,073 | 7/1978 | Curran | 239/14.2 |
| 4,480,788 | 11/1984 | Manhart | 239/14.2 |
| 4,813,597 | 3/1989 | Rumney et al. | 239/2.2 |
| 4,919,331 | 4/1990 | Kosik, Sr. et al. | 239/2.2 |
| 5,360,163 | 11/1994 | Dupre | 239/14.2 |

FOREIGN PATENT DOCUMENTS

| | | |
|---|---|---|
| 2208471 | 8/1990 | Japan . |

*Primary Examiner*—Lesley D. Morris
*Attorney, Agent, or Firm*—Carothers & Carothers

[57] ABSTRACT

A snow making tower wherein air and water are supplied under pressure to the top of the tower and discharged under pressure through nozzles to form plumes of atomized water for producing snow in subfreezing conditions. Additional water nozzles are positioned at the top of the tower to discharge more water in the form of spray that is directed into the previously described plumes of atomized water. This additional supply of water is independently valved for different ambient temperature conditions.

30 Claims, 6 Drawing Sheets

METHOD AND APPARATUS FOR MAKING SNOW

BACKGROUND OF THE INVENTION

This invention relates generally to the art of fluid sprinkling and more particularly to the manufacture of snow. Specifically, the present invention relates to snow making towers for manufacturing snow on ski slopes.

The present invention pertains to improvements over the inventions of Herman K. Dupre disclosed in U.S. Pat. No. 3,822,825, issued Jul. 9, 1974, U.S. Pat. No. 3,952,949, issued Apr. 27, 1976 and U.S. Pat. No. 5,004,151, issued Apr. 2, 1991.

These former inventions for artificially producing snow consist of method and apparatus for making snow through the use of snow towers wherein water is supplied under pressure to a point of discharge well above ground level and adjacent the top end of the tower where it is discharged through a first water nozzle into the ambient freezing atmosphere in the form of a spray. The spray is preferably a high velocity spray of discrete water particles, sometimes referred to as a fine water spray.

Air is also supplied independently under pressure to a second point of discharge at the top of the snow tower and there discharged through an orifice to form a jet of air which is directed into the throat of the aforementioned water spray thereby forming a plume of atomized or nucleated water. This atomized water forms seed crystals in a freezing atmosphere, and through the dwell time of the long fall from the top of the tower to the ground, forms snow.

U.S. Pat. No. 5,004,151 illustrates the same principals but further increases the efficiency of the water tower in colder subfreezing ambient conditions. This is accomplished by adding additional water discharge nozzles at the top of the tower which further discharge water spray into the plume already created by the previously described discharge of an air jet directed into the throat of the sprayed water.

While this prior art system is extremely efficient, it is always desirable to make larger quantities of excellent quality snow over the same period of time, and to make quality snow at higher ambient temperatures with greater efficiency and lower cost.

It is a principal object of the present invention to provide apparatus for making snow even at higher marginal subfreezing temperatures, and to do so at excellent efficiency rates at a lower cost.

SUMMARY OF THE INVENTION

In the method and apparatus for making snow of the present invention, air and water under pressure are combined in a common elongated pipe or conduit and discharged at the upper end from a common nozzle to form a plume of atomized water, or alternatively, a first elongated water conduit, generally a very tall aluminum pipe, having upper and lower ends is provided and adapted for mounting on a ground support. A water discharge nozzle is provided adjacent the upper end of this water conduit for discharge of water alone under pressure in the form of a jet stream.

In this alternate version, a separate air conduit is also provided and additionally adapted for mounting on the same support for coextending with the water conduit. Accordingly, the water and air conduit may run side by side, or the air conduit, which is also made of aluminum, preferably coextends within the water conduit in order to prevent freezing of moisture in the air line by keeping the same warm with the outer jacket of insulating water, as taught in the aforementioned Herman K. Dupre patents. The air line may be coaxially mounted in the water line, or the tower pipe may be extruded with separated segments for water and air.

An air discharge nozzle or orifice is provided adjacent the upper end of the air conduit and it is positioned adjacent the first water discharge nozzle to discharge air into the throat of the water spray thereby forming a plume of atomized water by external interaction of air and water under pressure to produce snow in subfreezing conditions.

Typically, at subfreezing conditions between 25°–30° F., prior art snow making guns require at least 12 to 20 cfm of air with 1 gallon of water per minute in order to function, and then they are not capable of making good quality snow.

Then, when the subfreezing ambient conditions are such that the temperature falls below 25° F., the teachings of Dupre U.S. Pat. No. 5,004,151 can be brought into play by discharging additional water under pressure in the form of a spray into the previously created atomized water plume in order to optimize the snow manufacturing capabilities of the snow making tower of the present invention. Under these conditions, it is possible to make large quantities of snow at great efficiencies whereby only one gallon of water is being utilized for each one cfm of air being discharged. Under these latter mentioned conditions, a second water discharge nozzle is positioned adjacent the first water discharge nozzle at the top of the tower for directing at least a portion of the water discharged therefrom under pressure into the plume of atomized water.

In accordance with the teachings of the present invention, this second water discharge nozzle is supplied by a second and separate elongated water conduit which coextends with the aforedescribed combined or separate air and first water conduits. A control valve is connected to the lower end of this second additional water conduit for regulating the supply of water under pressure to this second water conduit.

Accordingly, the feed of water through the second water discharge nozzle can be completely and efficiently regulated from the ground by controlling the water supply valve. Thus when ambient freezing conditions are such that the temperature goes below 25° F., the attendant can easily put the second water nozzles into play by turning them on at the base of the tower or by remote control. Of course, valves for the air and first water conduit are also conventionally supplied at the base of the tower.

It is preferred that the tower elongated air conduit, when separate from the first water conduit, coextend (usually coaxially) within the elongated first water conduit, and that this combined first water conduit and air conduit, either as a common air and water conduit or as coaxial separate conduits, in turn coaxially coextend within the second additional water conduit.

Having these two or three aluminum pipes coaxially secured with each other, permits continued insulation of the internal air line when separate and also considerably strengthens the pipe tower so that it can be effectively used at even greater heights, for example at heights of from between 50 to 60 feet above the ground, when the air line is separate and three coaxial pipes are used.

It is generally preferred under the teachings of the present invention that this first water discharge nozzle in combination with the separate air discharge orifice, or a combined air and water discharge nozzle, be provided in multiples at the top of the snow making tower so that they provide a uniform pattern of distribution. In other words, if two such combinations are provided at the top of the tower, they are spaced at 180° so that the high pressures of water and air discharge oppose each other and have the effect of canceling each other and thereby do not exert unduly high strains on the tower. Otherwise the tall tower of course provides a very long moment arm whereby the tower could be easily damaged.

In this regard, if three such water nozzle and air orifice combinations are provided at the top of the tower, they are spaced at 120°, and if four such combinations are utilized, as described hereinafter in the specification, then they are spaced at 90° from each other.

The control valve provided at the base of the snow making tower, which controls the supply of water under pressure to the second water conduit, is provided with an inlet that is positioned in-line with the water being fed under pressure to the first water conduit of the tower. This creates water turbulence at the control valve inlet and thereby prevents water freeze-up in the control valve and at the inlet of the control valve.

This control valve is also preferably secured by independent fasteners, such as bolts, directly to the supply conduit supplying water under pressure to the first water conduit whereby the inlet of the control valve is thereby positioned as close as possible to the supply of water under pressure to the tower thereby preventing freeze-up of the control valve. Old or prior art threaded connections are thereby eliminated which would prevent the valve inlet from being as close as possible to the supply of water under pressure.

The control valve is also preferably a ball valve as such ball valves tend to be less likely to stick in freezing conditions. The ball valve is also preferably a three-way valve that is adapted for gravity draining of water from the second or additional water conduit of the snow making tower when this control valve is in the off position such that water is not being supplied to the second water conduit of the tower.

BRIEF DESCRIPTION OF THE DRAWINGS

Other objects and advantages appear in the following description and claims.

The accompanying drawings show, for the purpose of exemplification, without limiting the invention or the claims thereto, certain practical embodiments illustrating the principals of this invention wherein:

DETAILED DESCRIPTION OF THE PREFERRED EMBODIMENTS

Figure 1:
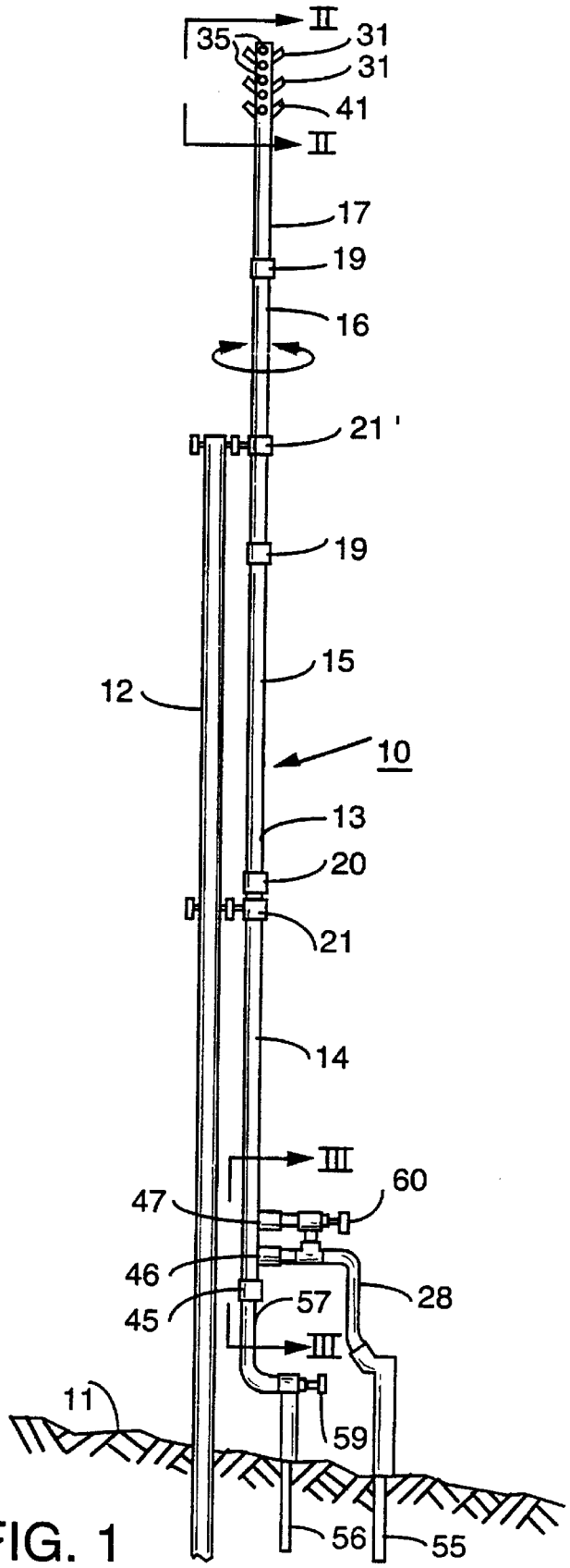
FIG. 1 is a view is side elevation of a snow making tower apparatus of the present invention.

Reference is now made to FIG. 1 wherein there is shown a snow making tower 10 incorporating the method and apparatus of the present invention. This apparatus shown is one of a plurality of snow making towers 10 which are positioned along a ski slope at ground level as indicated at 11 adjacent to a ski trail as illustrated in Herman K. Dupre U.S. Pat. No. 3,706,414.

The snow making tower 10 includes a support in the form of wood pole 12 anchored in the ground 11. Other support mechanisms, even of the adjustable type, may be employed such as disclosed in Dupre U.S. Pat. No. 5,360,163.

The support 12 supports elongated water conduit 13 which is fabricated of metallic thermally conducting material such as aluminum. Aluminum provides necessary lightness and strength to permit the tower to exceed desired heights above the ground when supported from pole 12 and is also a good heat conductor.

Elongated hollow conduit 13 may be comprised of a single aluminum tubular extrusion or it may be comprised, as illustrated, of four pipe sections 14, 15, 16 and 17. Pipe sections 15, 16 and 17 are joined by aluminum couplings 19, and pipe sections 14 and 15 are joined together by steel coupling 20.

The reason coupling 20 is fabricated of steel, instead of aluminum, is that the underside of coupling 20 rests upon support bracket 21, which in turn is through bolted to pole 12 as indicated. This permits the entire elongated conduit 13 to be rotated about its vertical axis as indicated by the arrow in order to position the upper pipe section 17 with its incorporated water spray nozzles and air discharge orifices anywhere within a 360° pattern about the vertical axis of conduit 13 to compensate for varying wind conditions. Steel coupling 20 will not wear down as readily as would an aluminum coupling when bearing down on the upper surface of support bracket 21.

Of course, as previously indicated, a completely different type of adjustable support mechanism may be utilized and the support and adjustment mechanisms for the support is not a feature of the present invention.

The basic structure of the snow making tower shown in FIG. 1 is also illustrated in Dupre U.S. Pat. No. 5,004,151 and reference can be made to that reference for further information on the basic operation of the conventional portions of the tower shown, and accordingly that patent reference is incorporated herein by reference.

Support brackets 21 and 21' in this instant merely consist each of a hinge wherein a portion of one hinge leaf is bent in the form of a loop to loosely enclose pipe section 14.

Figure 2:
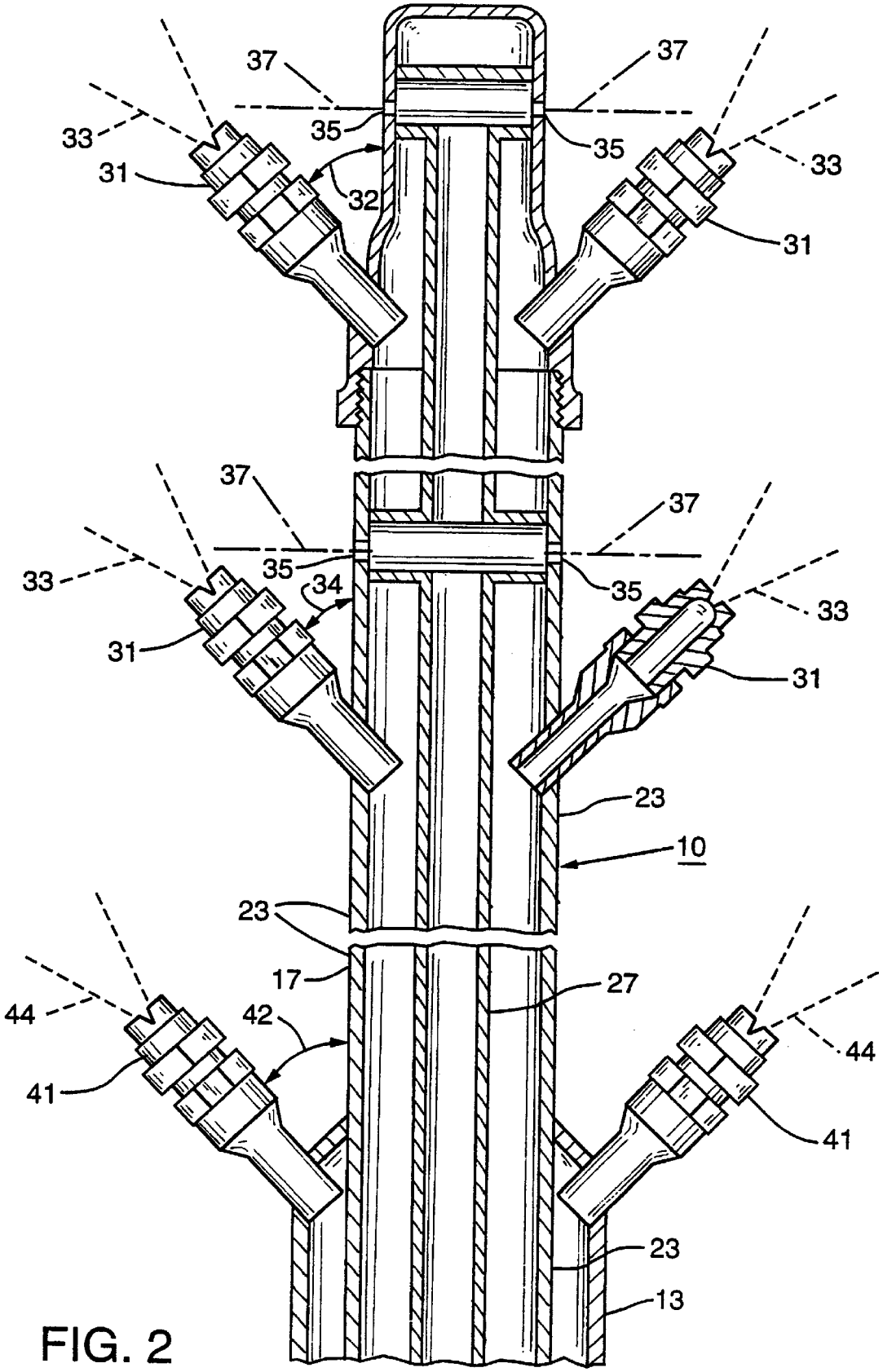
FIG. 2 is an enlarged sectional view of the upper end of the snow making tower illustrated in FIG. 1 as seen along section line II—II.
Figure 3:
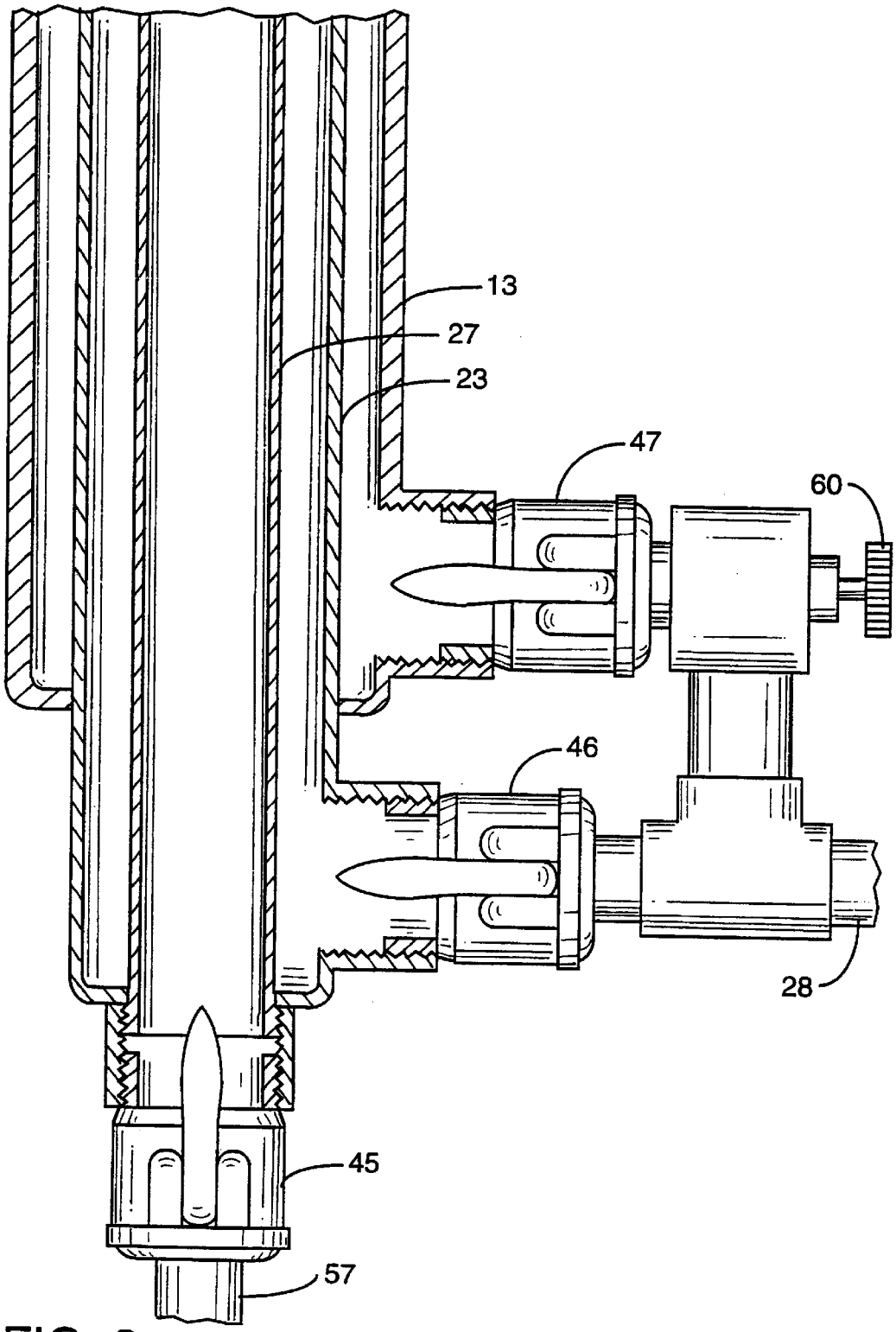
FIG. 3 is an enlarged view in partial vertical section of the lower end of the snow making tower illustrated in FIG. 1 as seen along section line III—III with the tower support removed for clarity.
Figure 4:
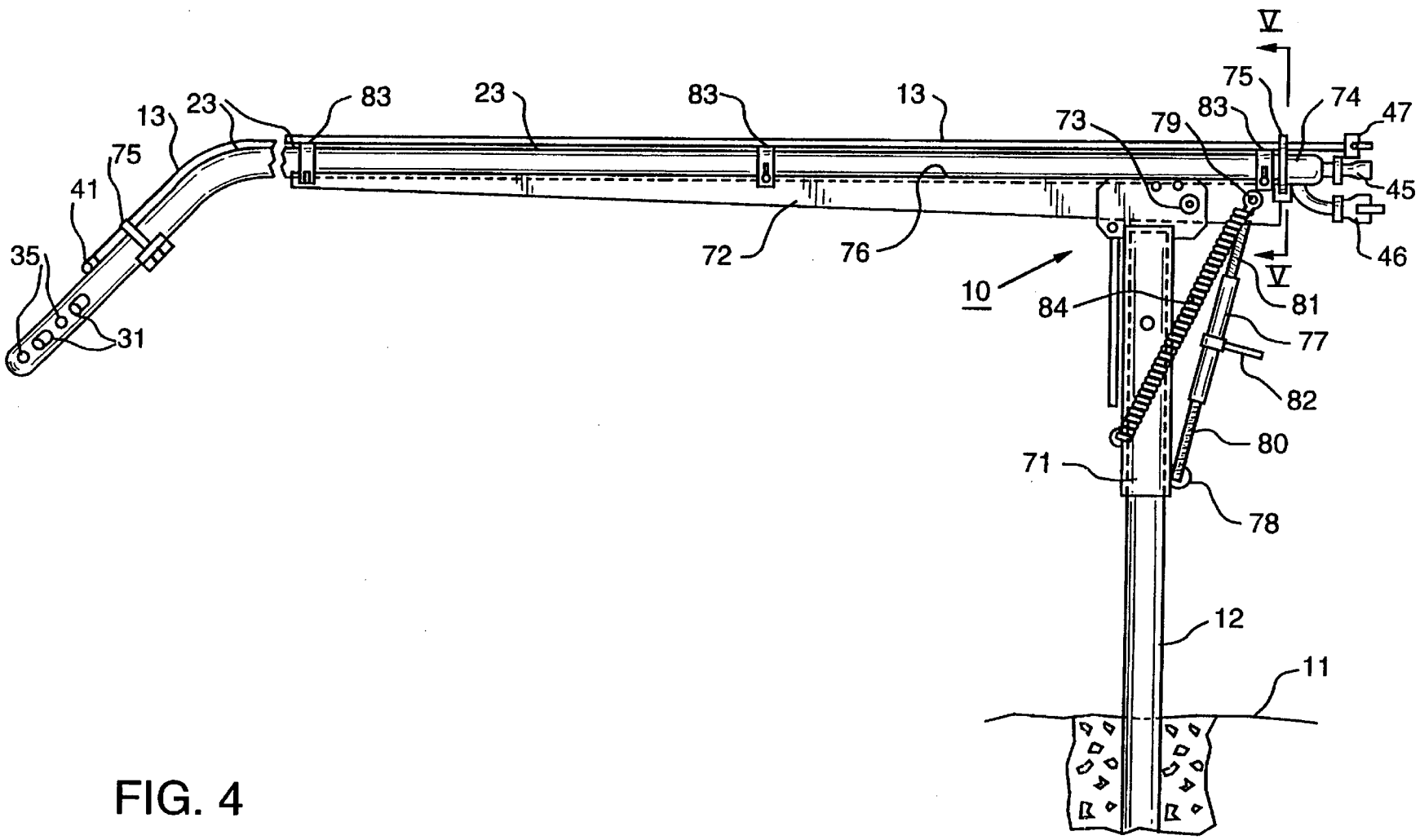
FIG. 4 is a view in side elevation of the snow making tower of the present invention illustrating a variation of the embodiment of the present invention shown in FIGS. 1 and 2.

With additional reference to FIGS. 2 through 4, it will be observed that there is a coaxial water supply conduit 23 within water conduit 13 and in addition there is a coaxial air conduit 27 within water conduit 23.

Air under pressure is supplied to the air discharge orifices 35 at the top of tower 10 for discharging the supplied air therethrough under pressure into the ambient atmosphere in the form of jet streams 37.

This air under pressure is supplied from a more remote source underground through pipe 56 and it may be valved off by supply valve 59.

Water is also independently supplied under pressure through internal conduit 23, that jackets air conduit 27, to a second point of discharge above the ground or to water discharge nozzle 31 (see FIGS. 2 and 4) for discharge of water under pressure in the form of sprays 33.

Air discharge orifices 35 and water nozzles 31 are positioned with respect to each other such that air is discharged from each air nozzle 35 is discharged in the form of a jet stream 37 which is directed into the throat of a water spray thereby forming a plume 33 of atomized water to produce snow in subfreezing conditions.

Second water discharge nozzles 41 are provided adjacent to the first discharge nozzle and air orifice combinations 31, 35 for directing at least a portion of water discharged therefrom in the form of sprays as indicated at 44 under pressure into respective plumes 33.

With particular reference to FIGS. 1, 2 and 3, water under pressure is supplied from a remote source through underground pipe 55, which supplies water conduit 23 through flexible hose 28. This supply of water to conduit 23 is regulated by valve 58.

In a similar manner, the supply of water from pipe 55 to outer or additional conduit 13 is regulated by valve 60 and passes to the conduit through flexible hose 61.

Accordingly, the water supply to additional water nozzles 41 may be independently controlled from the supply of water to first water nozzles 31. Therefore, when the ambient subfreezing atmosphere reaches 25° or warmer, the water supply to nozzles 41 may be shut down through the use of valve 60 at the base of the tower or remotely by solenoid operation.

With particular reference to FIG. 3, flexible hose 57 is connected to air supply conduit 27 through the use of a conventional quick connect coupler 45 and in a similar fashion a flexible water hose 28 is respectively connected to conduits 23 and 13 with quick connect couplings 46 and 47.

As is best illustrated in FIG. 2, it is preferable to use a plurality of first water discharge nozzles 31 and air discharge orifices 35 in combination and to place them about the top of the tower so that they form a plurality of respective plumes in a uniform pattern of distribution. Accordingly, the large torque arm forces applied to the upper end of tower 10 by discharge of air and water under pressure cannot damage the tower since the respective water discharge nozzle 31 and air discharge orifice 35 combinations are positioned opposite each other whereby the forces cancel each other.

In FIG. 2, four water discharge nozzle and air discharge orifice combinations 31, 35 are illustrated whereby they are positioned 90° from each other in the upper set pair and in the lower set pair to uniformly distribute the discharge therefrom to form four uniformly distributed atomized water plumes to produce snow in subfreezing ambient conditions.

Accordingly, if only two such water discharge and air orifice combinations are used, then they would be positioned opposite each other at the upper end of the tower and spaced at 180° from each other. If three such combinations are utilized then they would be spaced from each other by 120°.

In FIG. 2, the angles 32 and 34 between water nozzles 31 and conduit 23 are illustrated as 45°. Additionally, the angles between air jets 37 and water nozzles 31 is also 45°. Angle 42 of additional water nozzles 41 relative to conduit 23 is set at approximately 35°, instead of 45°, so that more of the additional water spray 44 will find its way into plumes 33 thereabove.

It has been discovered that the best and most efficient nucleation of the water sprays 33 caused by the interaction with respective air jet streams 37 is accomplished when the angle between water nozzles 31 and air jet streams 37 is maintained at 45°. However, it has also been discovered that it is desirable to maintain angles 32 and 34 at something other than 45°, while continuing to maintain the aforedescribed angle between air jet streams 37 and water nozzles 31 at 45°.

When air jet streams 37 intersect with the throat of water sprays 33, the air jet streams 37 deflect the water sprays 33 slightly outward and the result is that the water sprays 33 of atomized water are deflected outwardly as though angles 32 and 34 were something greater than 45°.

45° relative to vertical is the desired angle to maintain for atomized water plumes 33 in order to maintain the maximum throw of the atomized plumes from the tower top and to provide the maximum ground coverage of the artificially manufactured snow. Therefore, in order to maintain the proper angular relationship of atomized water plumes 33, angle 32 is maintained at approximately 30°, instead of 45° so that the resultant atomized plumes 33 as deflected by upper air jet streams 37 are actually deflected at an angle 32 which is something greater than 30°. This provides maximum coverage of snow fall in front of or in close to the tower while still maintaining the proper angle between jet streams 37 and upper water nozzles 31 at 45°.

Similarly, angles 34 of water nozzles 31 relative to conduit 23 might preferably be maintained at approximately 35°. The result is that through deflection of plume 33 by interacting air jet streams 37, the atomized plumes 33 in actuality maintain an angle 34 which is 45°, instead of 35°, relative to conduit 23. This provides maximum throw and spread of the plumes 33 coming from lower nozzles 31 and provides maximum snow ground coverage beyond the reach of upper nozzles 31 to thereby provide a more uniform ground coverage with the combination of the upper two sets of water nozzles 31 and air nozzles 35 in combination with the lower set of combination water nozzles 31 and air nozzles 35.

Angles 42 of lower additional water nozzles 41 are maintained at approximately 35°, as previously mentioned, so that at least most of the water spray 44 will be directed into upper atomized plumes 33.

Figure 5:
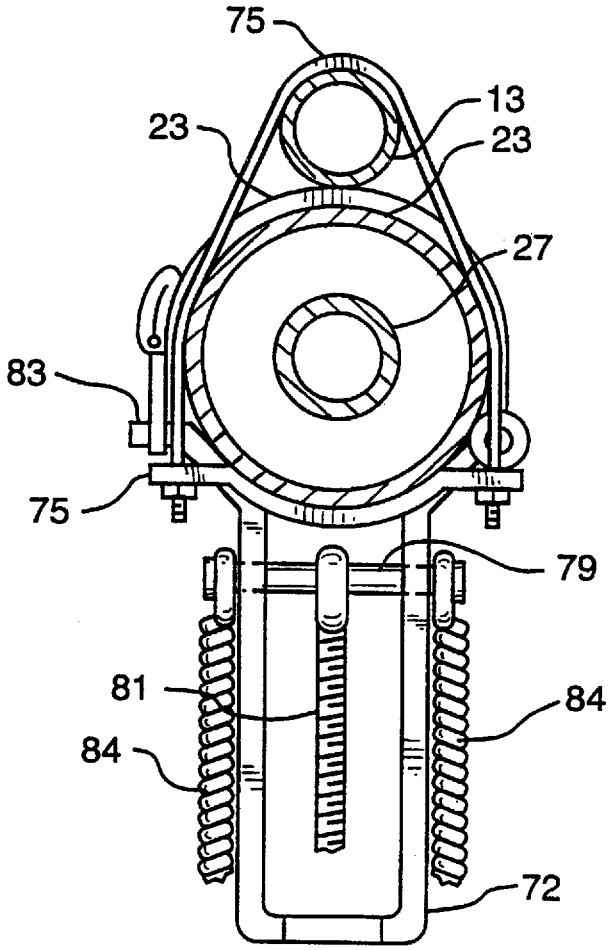
FIG. 5 is an enlarged sectional view of the lower end of the snow making tower illustrated in FIG. 4 as seen along section line V—V.

Referring next to the snow tower embodiment of the present invention illustrated in FIGS. 4 and 5, parts having the same or similar function as those shown in the remaining figures are designated with the same reference numeral.

The snow making tower shown in FIGS. 4 and 5 is adapted or converted to perform by externally adding on an extra or additional water conduit 13 to the tower structure with additional water nozzles 41 being provided at the upper end thereof, at the same angles and for the same purposes as water nozzles 41 shown in the embodiment of FIG. 2.

Additional water conduit 13 is secured to first water conduit 23 and the rest of the tower 10 by means of brackets 75. In this fashion such snow towers 10 already in use on the ski slopes may be readily adapted to perform functions of the snow making towers of the present invention. Although not shown in FIG. 4, the water supply to couplings 45 and 47 is supplied in the same fashion as shown in FIG. 1 with water supply line 28 and additional water valve 60 to selectively valve off or on the water supply to conduit 13. The structure and function of valve 16 will be explained in more detail hereinafter in regard to FIG. 6.

The snow tower structure 10 illustrated in FIGS. 4 and 5 varies from the basic structure shown in FIG. 1 in that the tower 10 of FIGS. 4 and 5 is a lean-out tower which pivots or rotates not only in a horizontal plane, but also rotates about its base 74 at pivot point 73 in a vertical plane. Rotation in a horizontal plane is provided by support pipe 71 which is rotatably received over the upper end of ground support pipe or pole 12. Relative rotation between upper support pipe 71 and ground support pole 12 may be locked in at any desired position in a conventional manner by a set screw.

In order to easily assist an operator in raising and lowering conduits 23 and 13 as supported on arm 72 with brackets 83, a conventional jack screw 77 is pivotally mounted at its lower end 78 to support pipe 71 and also pivotly mounted at its upper end 79 to arm 72. The upper threads 81 of jack 77 are left hand threads and the lower threads 82 are right hand threads so that when the ratchet mechanism of jack 77 is operated by manipulation of handle 80, arm 72 is either raised or lowered by pivoting about pivot point 73, depending upon the ratchet drive direction selection made on jack 77.

The raising of conduits 13, 23 and arm 72 vertically about pivot 73 is further assisted by the use of stretch counterbalance springs 84.

It should be kept in mind that while the apparatus of the present invention has been herein explained in relationship to a snow making tower which utilizes external interaction and mixing of air and water as shown at 37 and 33, the teachings of the present invention may also be applied to those snow making towers wherein the air and water is co-mingled and intermixed within the snow making tower conduit and the intermixed combination of air and water is ejected through common nozzles to form an atomized plume of water for manufacturing snow in subfreezing conditions, as is and was done for many years prior to the invention and use of the Dupre external mixing towers.

Figure 6:
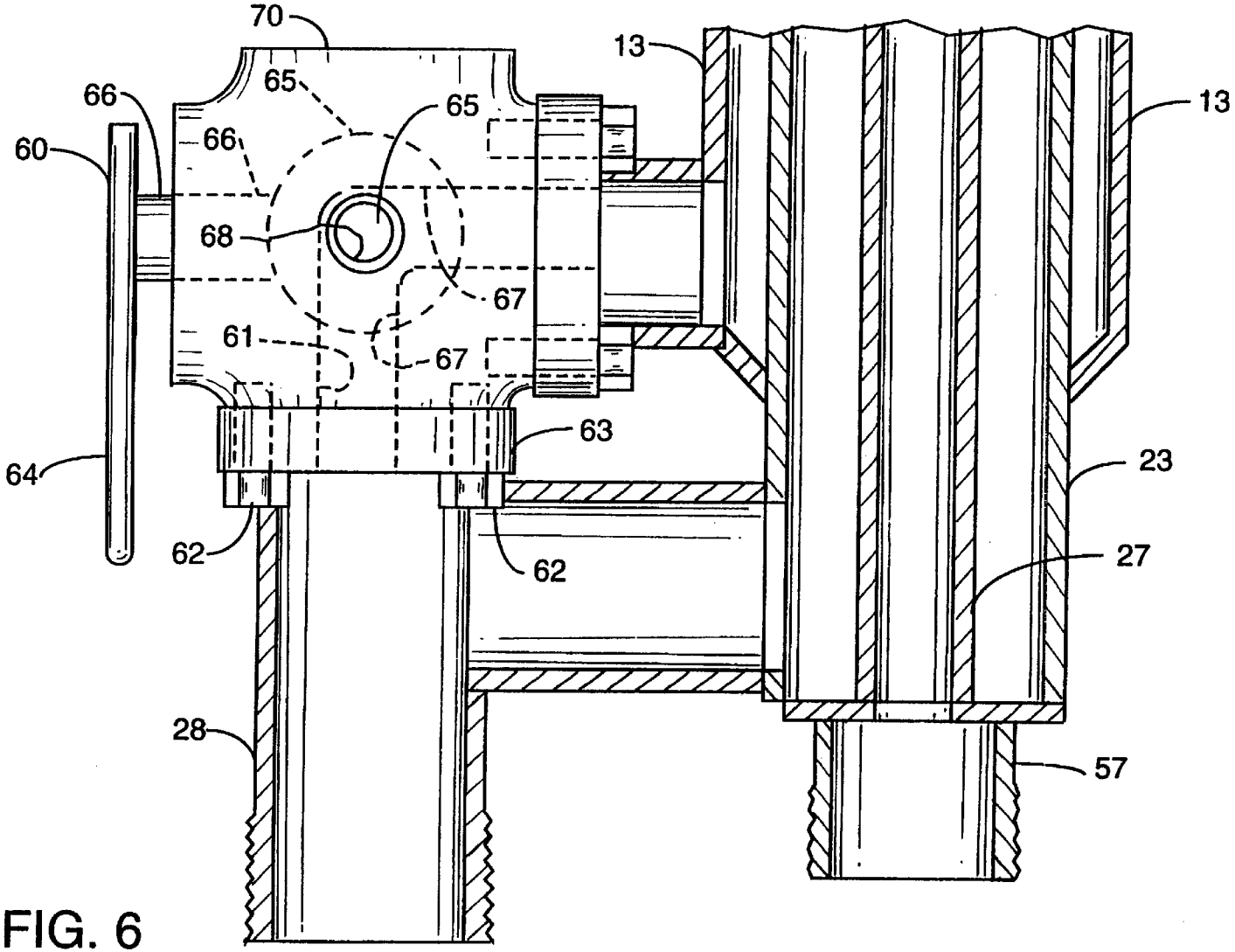
FIG. 6 is an enlarged view in partial vertical section of the lower end of the snow making tower illustrated in FIG. 1 as seen along section line III—III with the tower support removed for clarity and which illustrates variations in the control valving mechanism shown in FIG. 3.

Referring now to FIG. 6, a variation of the control valve mechanism for the second water conduit 13 is illustrated.

The control valve 60 is provided with an inlet 61 which is positioned in-line as illustrated in the figure with water supply conduit 28, which is supplied with water under pressure from a remote source. This creates significant water turbulence at the valve inlet 61 thereby preventing water freeze-up within the inlet and also the warmth of the turbulent water prevents valve 60 from otherwise freezing.

Control valve 60 is secured by independent fasteners or bolts 62, via pipe flange 63, directly to supply conduit 28 whereby inlet 61 is positioned as close as possible to the supply of water under pressure within pipe 28 to prevent freeze-up of the control valve. This connection prevents the requirement of conventional threaded pipe connections which would add considerable length to the connection and would further remove inlet 61 of valve 60 from the water supplied under pressure within pipe 28.

Control valve 60 is a ball valve controlled by lever 64 which turns valve ball 65 by stem 66 in order to turn the valve on and off.

In FIG. 6, ball valve 60 is shown in its on position whereby ball valve passage 67 is aligned to provide the passage of water under pressure from pipe 28 through the valve passage on into the second water conduit 13.

Ball valve 60 is a three-way valve so that when valve handle 64 is turned to the off position, drain passage 68 in the housing 70 of ball valve 60 will drain water directly from the inside of second or additional water conduit 13 through ball valve passage 67 and out drain passage 68. This drains all of the water from the second conduit 13 of the water tower so that water will not freeze-up within second water conduit 13.

The advantage of this arrangement is that no electric heat is required to thaw the ball valve or the application of a torch is not required. The warmth of the supply water in and of itself will maintain the ball control valve frost free.

We claim:

1. A snow making tower including air and first water elongated conduit means at least twenty feet high and having upper and lower ends and adapted for mounting on a support, air and first water discharge nozzle means provided adjacent the upper end of said conduit means for producing a plume of atomized water from interacting air and water discharged under pressure from said air and first water discharge nozzle means to produce snow in sub-freezing ambient conditions; the improvement comprising: a second elongated water conduit having upper and lower ends and adapted for mounting on said support and extending with said first water conduit means; and a second water discharge nozzle adjacent the upper end of said second water conduit; said second water discharge nozzle positioned for directing at least a portion of water discharged therefrom under pressure in the form of a spray into said plume.

2. The snow making tower of claim 1 wherein said conduits are metal and said first air and water elongated conduit means is comprised of an elongated air conduit extending within an elongated first water conduit, and couplings for connecting air and water under pressure respectively to the lower ends of said air conduit and said first and second water conduits.

3. The snow making tower of claim 2 wherein said first water conduit coextends within said second water conduit.

4. The snow making tower of claim 2 wherein said second water conduit is externally mounted on said first water conduit.

5. The snow making tower of claim 4 wherein said second water conduit engages said first water conduit for heat transfer.

6. The snow making tower of claim 2 wherein said tower is rotatably mounted on said support for horizontal rotation.

7. The snow making tower of claim 6 wherein said conduits are also mounted on said support for vertical rotation adjacent their lower ends.

8. The snow making tower of claim 2 including a valve disposed at the lower end of said second water conduit for regulating the supply of water under pressure to said second water conduit.

9. The snow making tower of claim 8 wherein said valve is a three-way valve connected to drain said second water conduit when said valve is in an off position.

10. A snow making tower including an elongated conduit combination comprised of an elongated air conduit extending within an elongated first water conduit and having upper and lower ends and adapted for mounting on a support, air and first water discharge nozzles provided respectively adjacent the upper ends of said conduits for producing a plume of atomized water from interacting air and water discharged under pressure from said air and first water discharge nozzles to produce snow in sub-freezing ambient conditions; the improvement comprising: a second elongated water conduit having upper and lower ends and adapted for mounting on said support and extending with said first water conduit; and a second water discharge nozzle adjacent the upper end of said second water conduit; said second water discharge nozzle positioned for directing at least a portion of water discharged therefrom under pressure in the form of a spray into said plume; and a control valve connected to the lower end of said second water conduit for regulating the supply of water to said second water conduit.

11. The snow making tower of claim 10 wherein said first water conduit extends within said second water conduit.

12. The snow making tower of claim 10 wherein said conduit combination is at least twenty feet high.

13. The snow making tower of claim 12 including means for connecting air and water under pressure respectively to the lower ends of said air conduit and said first and second water conduits.

14. The snow making tower of claim 13 wherein said tower is rotatably mounted on a support.

15. The snow making tower of claim 13 wherein said conduits are metallic.

16. The snow making tower of claim 13 wherein said first water conduit extends within said second water conduit.

17. The snow making tower of claim 13 wherein said second water conduit externally extends with said first water conduit.

18. The snow making tower of claim 13 wherein all air under pressure required to produce said plume of atomized water is supplied from a remotely located air compressor, thereby eliminating requirement of an air fan.

19. The snow making tower of claim 13 wherein said control valve has an inlet positioned in-line with water being fed under pressure to said first water conduit for creating water turbulence at said valve inlet to prevent water freeze-up.

20. The snow making tower of claim 19 wherein said control valve is secured by independent fasteners directly to a supply conduit supplying water under pressure to said first water conduit whereby said inlet is positioned as close as possible to the supply of water under pressure to prevent freeze-up of said control valve.

21. The snow making tower of claim 20 wherein said control valve is a ball valve with a valve ball positioned close to said inlet to prevent freeze-up of said valve ball.

22. The snow making tower of claim 21 wherein said ball control valve is a three-way valve connected for gravity draining of water from said second water conduit when said control valve is in an off position whereby water is not being supplied to said second water conduit.

23. A snow making tower comprising an elongated first water conduit at least twenty feet high and an elongated air conduit extending within said first water conduit, said conduits mounted on a support, a first pair of air and water nozzle sets respectively provided adjacent upper ends of said air and water conduits and positioned on opposite sides thereof and further positioned for producing plumes of atomized water on opposite sides of the tower from interacting air and water discharged under pressure from said nozzle sets to produce snow in sub-freezing ambient conditions, a second pair of said nozzle sets positioned on opposite sides of said conduits and positioned vertically adjacent said first pair of nozzle sets, a second elongated water conduit having upper and lower ends and extending with said first water conduit, an additional water discharge nozzle at the upper end of said second water conduit and positioned for directing at least a portion of water discharged therefrom under pressure in the form of a spray into at least one of said plumes, couplings for connecting air and water under pressure respectively to the lower ends of said air and said water conduits, and a control valve connected to the lower end of said second water conduit for regulating the supply of water to said second water conduit.

24. The snow making tower of claim 23 wherein said conduits are metal.

25. The snow making tower of claim 24 wherein said conduits are mounted on said support for horizontal rotation.

26. The snow making tower of claim 5 wherein said conduits are also mounted on said support for vertical rotation adjacent their lower ends.

27. The snow making tower of claim 23 wherein said air and water nozzle sets each provide an air jet which intersects with a water spray throat at an angle of intersection which is approximately 45°.

28. The snow making tower of claim 27 wherein said water nozzles of said first pair of nozzle sets are positioned to provide upwardly directed water sprays which are angled at approximately 30° relative to said first water conduit.

29. The snow making tower of claim 28 wherein said water nozzles of said second pair of nozzle sets are positioned to provide upwardly directed water sprays which are angled at approximately 35° relative to said first water conduit.

30. The snow making tower of claim 29 wherein said additional water nozzles are positioned below said first and second nozzle sets and are positioned to provide upwardly directed water sprays which are angled at approximately 35° relative to said first water conduit.

* * * * *